United States Patent [19]

Suzuki et al.

[11] 4,051,942

[45] Oct. 4, 1977

[54] PRINTING APPARATUS

[75] Inventors: Takeo Suzuki; Ikutaro Inoue; Hideo Tamai; Masatsugu Aoki, all of Soma, Japan

[73] Assignee: Alps Electric Co., Ltd., Tokyo, Japan

[21] Appl. No.: 731,460

[22] Filed: Oct. 12, 1976

[30] Foreign Application Priority Data

Oct. 11, 1975 Japan ..... 50-122787

[51] Int. Cl.[2] ..... B41J 1/24

[52] U.S. Cl. ..... 197/49; 101/93.16; 178/34; 235/61.9 R

[58] Field of Search ..... 197/1 R, 18, 52, 49, 197/48, 82; 101/93.09, 93.15–93.19, 93.38–93.40, 90, 93.45; 178/33, 34, 26; 235/61.9 R

[56] References Cited

U.S. PATENT DOCUMENTS

| | | | |
|---|---|---|---|
| 3,286,625 | 11/1966 | Petit | 101/93.09 |
| 3,374,873 | 3/1968 | Takenaka | 197/49 |
| 3,442,364 | 5/1969 | Ragen | 101/93.19 X |
| 3,630,335 | 12/1971 | Chamness | 197/49 |
| 3,850,097 | 11/1974 | Sweeney | 235/61.9 X |
| 3,957,151 | 5/1976 | Kashio | 197/49 |

*Primary Examiner*—Ralph T. Rader
*Attorney, Agent, or Firm*—Guy W. Shoup

[57] ABSTRACT

A printing apparatus for an electronic calculator or the like comprises a first type wheel formed with mathematical operator symbols which is fixed to a spline shaft and a second type wheel formed with digits which is slidably mounted on the spline shaft for integral rotation. A stepping motor rotates the spline shaft for character selection. A carriage is connected to the second type wheel and is movable by a cable wound around drive and take-up spools to move the second type wheel along the spline shaft for serial feed. A single electrical solenoid actuates a printing hammer for printing and subsequently actuates a ratchet and pawl mechanism to serially feed the second type wheel by one character position in one reciprocation of the solenoid plunger. A linkage initially connects the plunger to a first printing hammer associated with the first type wheel to print the mathematical operator and subsequently to a second printing hammer associated with the second type wheel to serially print digits from least significant to most significant.

10 Claims, 16 Drawing Figures

PRINTING APPARATUS

BACKGROUND OF THE INVENTION

The present invention relates to a mechanical printing apparatus for an electronic calculator or the like.

Although mechanical serial printing apparatus are generally known and are in widespread practical use, these apparatus are complicated in construction, expensive to manufacture and subject to malfunction.

SUMMARY OF THE INVENTION

It is therefore an object of the present invention to provide a mechanical printing apparatus for an electronic calculator or the like which is simpler in construction, less expensive to commercially manufacture and less prone to malfunction than prior art apparatus.

It is another object of the present invention to provide a printing apparatus comprising a first type wheel fixed to a spline shaft and a second type wheel slidable by means of a carriage along the spline shaft for serial feed. The spline shaft is rotated for character selection. A single electrical solenoid actuates a printing hammer associated with the selected one of the type wheels for printing and subsequently acutates ratchet and pawl mechanism to serially feed the second type wheel by one character position.

It is another object of the present invention to provide a generally improved printing apparatus for an electronic calculator or the like.

Other objects, together with the foregoing, are attained in the embodiment described in the following description and illustrated in the accompanying drawings.

DESCRIPTION OF THE PREFERRED EMOBIDMENT

While the printing apparatus of the invention is susceptible of numerous physical embodiments, depending upon the environment and requirements of use, substantial numbers of the herein shown and described embodiment have been made, tested an used, and all have performed in an eminently satisfactory manner.

Figure 1:
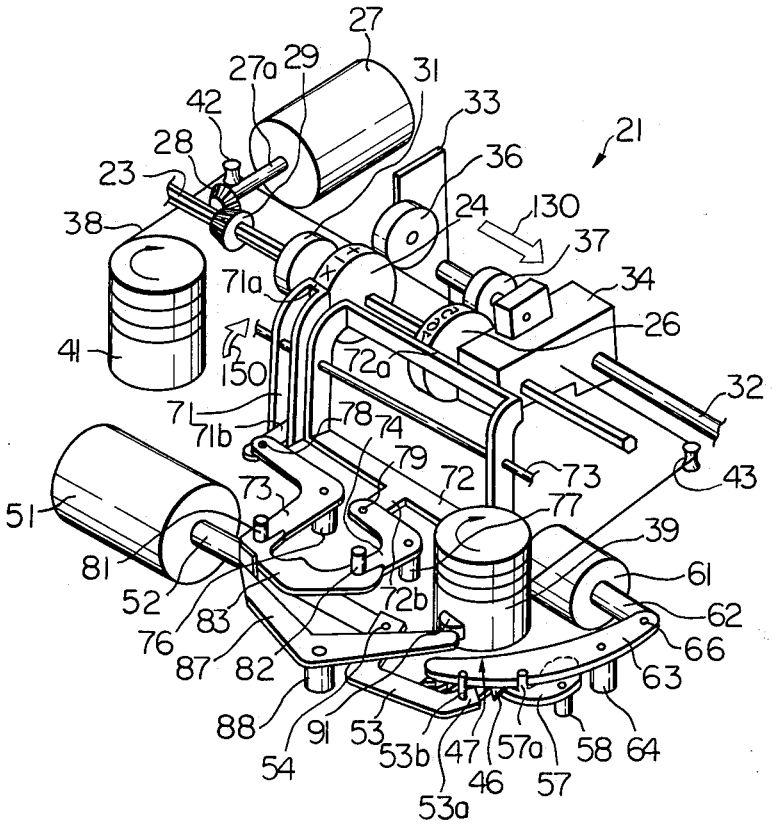
FIG. 1 is a perspective view of a printing apparatus emobodying the present invention.
Figure 2:
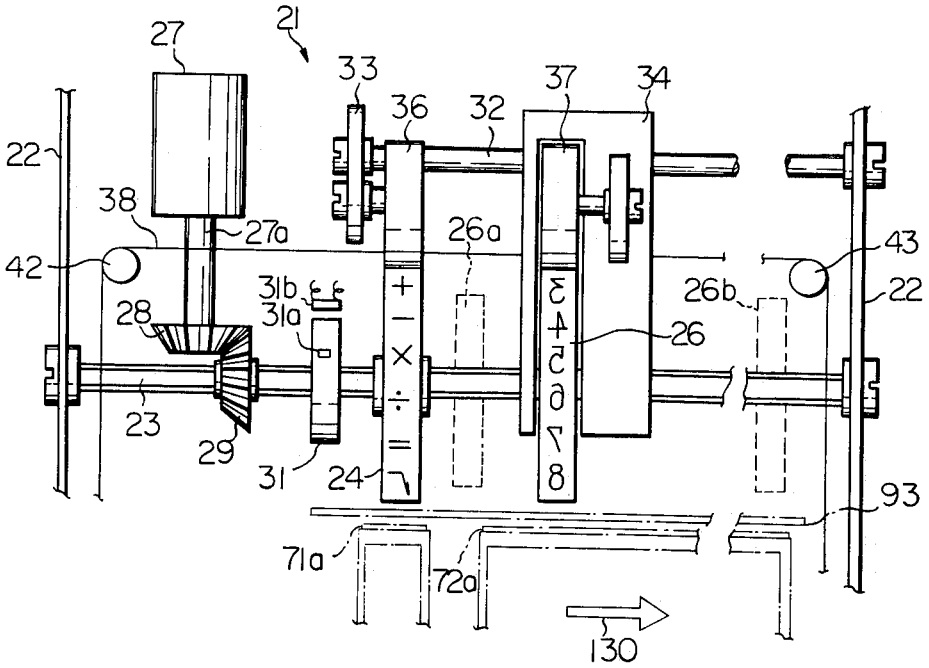
FIG. 2 is a fragmentary plan view of part of the printing apparatus.
Figure 3:
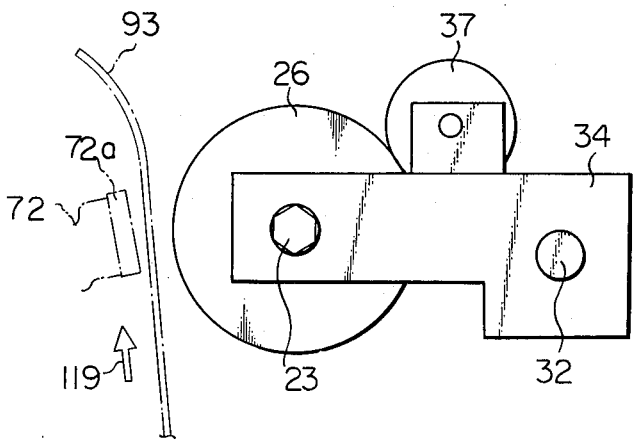
FIG. 3 is a fragmentary plan view of another part of the printing apparatus.

Referring now to FIGS. 1 to 3 of the drawing, a printing apparatus 21 embodying the present invention comprises a frame 22 which rotatably supports a spline shaft 23 at the ends thereof. A first type wheel 24 is fixed to the spline shaft 23 and has a plurality of type symbols formed on the circumference thereof. Where the printing apparatus 21 is employed in an electronic calculator (not shown), the synmbols on the type wheel 24 are preferably mathematical operator symbols comprising "=", "+", "−", "×" and "÷". A second type wheel 26 is slidably mounted on the spline shaft 23 and integrally rotatable therewith. The second type wheel 26 is also formed with a plurality of type symbols on the circumference thereof, in this case preferably comprising the digits "0" to "9" and the symbols "−" and ".". It is to be noted that the type symbols of the type wheels 24 and 26 are not limited to the mathematical operator symbols and the digits mentioned above, respectively.

A bevel gear 28 fixed to a shaft 27*a* of a stepping motor 27 meshes with a bevel gear 29 fixed to the spline shaft 23. A plastic disc 31 is also fixed to the spline shaft 23 and has a metal chip 31*a* fixed to the circumference thereof. A sensor 31*b* mounted adjacent to the disc 31 is arranged to feed an electrical control signal to a controller (not shown) of the stepping motor 27 when the metal chip 31*a* aligns with the sensor 31*b.* The stepping motor 27 serves to rotate the spline shaft 23 and thereby the type wheels 24 and 26 for character selection through the gears 28 and 29 as will be described in detail below.

A carriage support shaft 32 is fixedly supported at its opposite ends by the frame 22 and a support bracket 33 respectively. A carriage 34 is slidably supported by the carriage support shaft 32 and the spline shaft 23 which pass therethrough. The carriage 34 embraces the second type wheel 26 in such a manner as to be integrally slidable therewith along the spline shaft 23.

A first ink roller 36 is rotatably supported by the bracket 33 and is maintained in pressing engagement with the first type wheel 24. In a similar manner, a second ink roller 37 is rotatably supported by the carriage 34 and maintained in pressing engagement with the second type wheel 26. The ink rollers 36 and 37 are impregnated with a suitable ink and apply the ink to the type symbols on the type wheels 24 and 26 upon rotation thereof.

Although the first type wheel 24 is fixed in position on the spline shaft 23, the carriage 34 is slidable along the spline shaft 23 in such a manner that the second type wheel 26 is carried along therewith for movement between first and second positions shown in phantom line and designated as 26*a* and 26*b* respectively in FIG. 2. To accomplish this movement, a cable 38 is wound around a drive spool 39 and a take-up spool 41 and fixedly connected to the carriage 34 at an intermediate position. Guide pins 42 and 43 position the cable 38 so as to run parallel to the spline shaft 23. Rotation of the spools 39 and 41 as indicated by arrows in FIG. 1 winds the cable 38 onto the drive spool 39 and unwinds the cable 38 from the take-up spool 41 to move the carriage 34 and second type wheel 26 from the first position 26*a* toward the second position 26*b* in FIG. 2.

Figure 6:
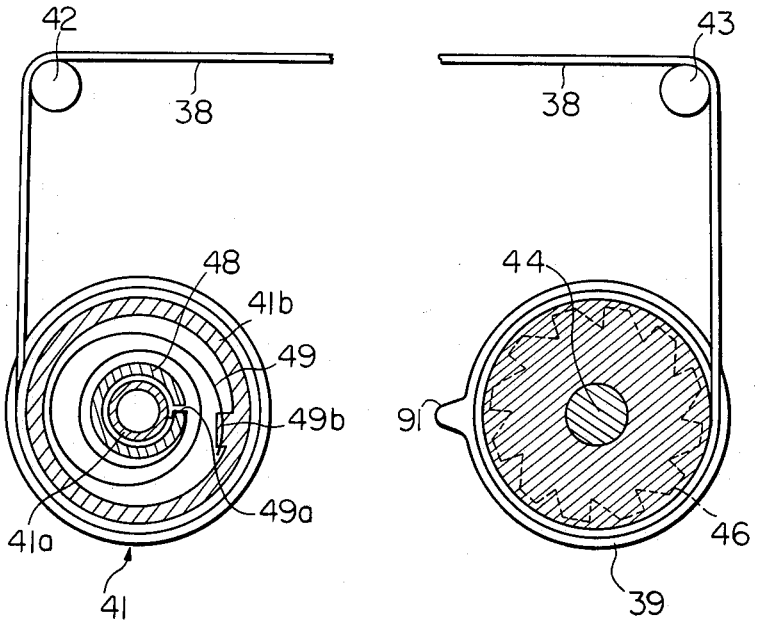
FIG. 6 is a fragmentary sectional plan view of a carriage feed spool arrangement of the printing apparatus.
Figure 7:
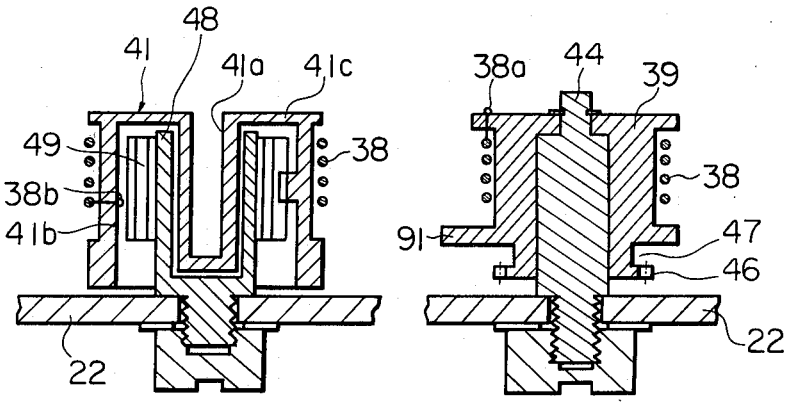
FIG. 7 is a fragmentary sectional elevation of the carriage feed spool arrangement.

Referring also to FIGS. 6 and 7, the drive spool 39 is rotatably supported by a vertical shaft 44 which is fixed to a horizontal portion of the frame 22. An end of the cable 38 is fixed to the spool 39 at 38*a.* A ratchet 46 is integrally formed with the drive spool 39 and a groove 47 is defined between the ratchet 46 and a cam 91 of the spool 39. The take-up spool 41 comprises an inner tube portion 41*a* which is rotatably supported inside a vertical tubular shaft 48 which is fixed to the frame 22. The cable 38 is wound around a coaxial outer tube portion 41*b* and fixed thereto at its other end as designated at 38*b*. The inner and outer tube portions 41*a* and 41*b* are connected together by an annular disc portion 41*c*. A spiral leaf spring 49 is disposed between the shaft 48 and the outer tube portion 41*b* and connected thereto at its opposite ends 49*a* and 49*b* respectively. The spring 49 urges the take-up spool 41 to rotate counterclockwise in FIG. 6 and thereby urges the drive spool 39 through the cable 38 to rotate counterclockwise and move the carriage 34 and second type wheel 26 to the first position 26*a*. As viewed in FIG. 1, the spring 49 urges the spools 39 and 41 to rotate opposite to the direction indicated by the arrows.

Figure 8:
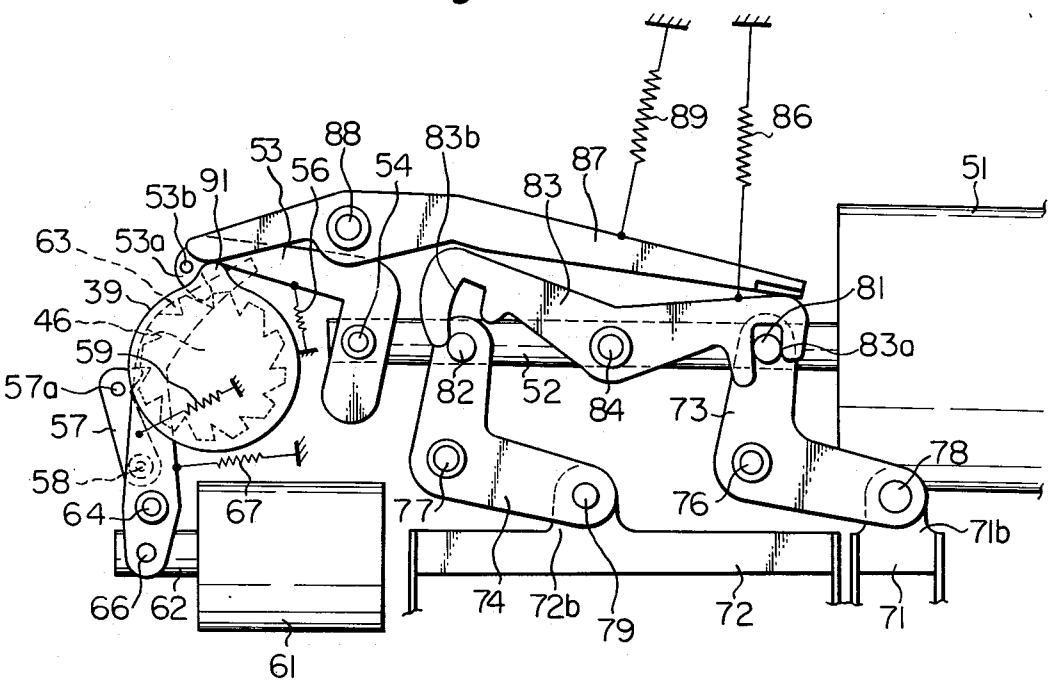
FIGS. 8 to 12 are fragmentary plan views illustrating the operation of a linkage arrangement of the printing apparatus.
Figure 9:
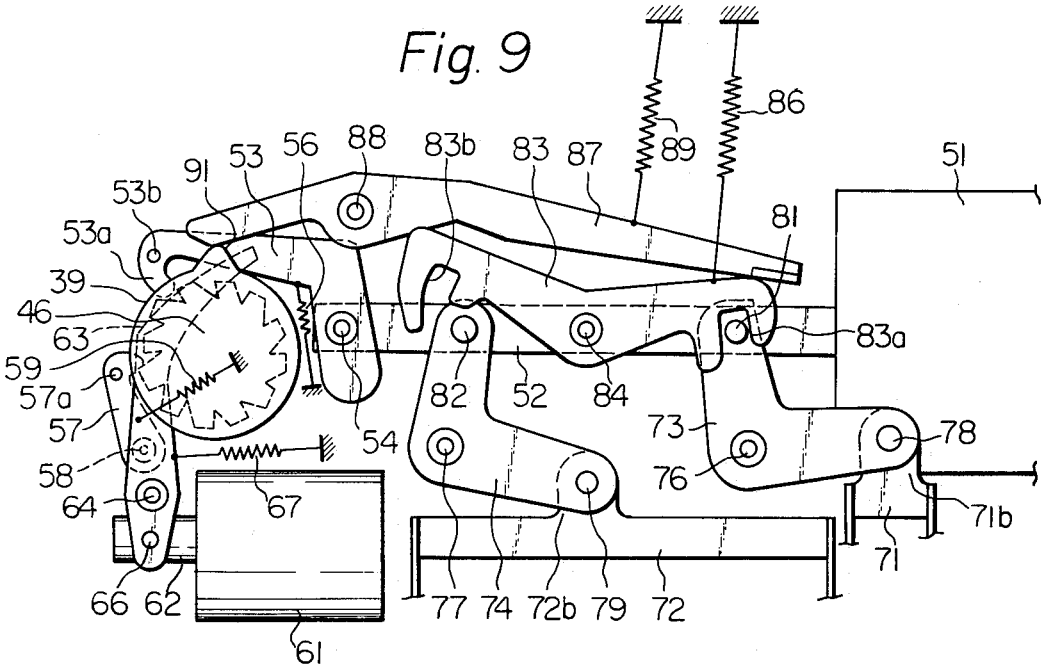

Referring also to FIG. 8, an electrical solenoid 51 comprises an actuator plunger 52 which is reciprocatable in and out of the solenoid 51 proper by a predetermined distance. The solenoid 51 is so constructed as to normally retract the plunger 52 thereinto to the position shown in FIG. 8 and to extend the plunger 52 therefrom in response to an electrical signal to the position shown in FIG. 9. A generally L-shaped drive pawl 53 is pivotally supported at the end of the plunger 52 about a pin 54, and a tension spring 56 urges the pawl 53 counterclockwise in FIG. 8 so that a hooked end 53*a* of the pawl 53 engages with the ratchet 46.

A holding pawl 57 is pivotally supported about a pin 58 and urged clockwise by a tension spring 59 into engagement with the ratchet 46. The holding pawl 57, while engaged with the ratchet 46, prevents counterclockwise rotation of the ratchet 46 and drive spool 39 in FIG. 8 and thereby prevents movement of the carriage 34 and second type wheel 26 from the second position 26*b* toward the first position 26*a*.

A carriage return electrical solenoid 61 comprises a plunger 62. An actuator lever 63 is pivotal about a pin 64 and pivotally connected to the plunger 62 by a pin 66. The solenoid 61 operates oppositely to the solenoid 51 in that the solenoid 61 retracts the plunger 62 in response to an electrical signal. The actuator lever 63 is urged clockwise in FIG. 8 by a tension spring 67 so as to abut against the radially inner wall of the groove 47 in the drive spool 39. Upon energization of the solenoid 61, the plunger 62 is retracted thereinto causing the actuator lever 63 to pivot counterclockwise in FIG. 8 into abutting engagement with pins 53*b* and 57*a* provided to the drive and holding pawls 53 and 57 respectively and rotate the pawls 53 and 57 clockwise and counterclockwise against the forces of the springs 56 and 59 respectively so that the pawls 53 and 57 disengage from the ratchet 46. The spring 49 provided to the take-up spool 41 will, with the pawls 53 and 57 disengaged, move the carriage 34 and second type wheel 26 to the first position 26*a*.

First and seccond printing hammers 71 and 72 are rockably supported by a shaft 73 which extends parallel to the spline shaft 23. The hammers 71 and 72 are formed as generally rectangular frames each having two vertical members and two horizontal members (not designated). As best seen in FIG. 2, hammer plates 71*a* and 72*a* are fixed to the upper horizontal members of the hammers 71 and 72 adjacent to the type wheels 24 and 26 respectively. The second hammer 72 extends between the first and second positions 26*a* and 26*b*.

First and second bell crank levers 73 and 74 are pivotal about pins 76 and 77 and are pivotally connected by pins 78 and 79 to lugs 71*b* and 72*b* extending from the lower horizontal members of the hammers 71 and 72 respectively. Engaging pins 81 and 82 are provided at the opposite ends of the bell crank levers 73 and 74 respectively.

A hammer selector lever 83 is pivotally supported by the plunger 52 about a pin 84 which extends perpendicularly from the plunger 52. The selector lever 83 is biased counterclockwise in FIG. 8 by a tension spring 86 to urge an engaging fork 83*b* at the left end of the selector lever 83 to engage with the pin 82 of the ballcrank lever 74 in the manner illustrated in FIG. 10. As viewed in FIG. 8, however, the selector lever 83 is moved clockwise against the force of the spring 86 by a selector arm 87 so that an engaging fork 83*a* at the right end of the selector lever 83 engages with the pin 81 of the bellcrank lever 73.

The selector arm 87 is pivotal about a pin 88 and urged counterclockwise in FIG. 8 by a tension spring 89 so that the left end thereof abuts against the peripheral surface of the cam 91 provided to the drive spool 39. The cam 91 is profiled so that in the position of FIG. 8 the selector arm 87 is rotated clockwise thereby against the force of the spring 89 so that the right end of the selector arm 87 engages with the right end of the selector lever 83 thereby rotating the selector lever 83 clockwise against the force of the spring 86 to engage the fork 83*a* of the selector lever 83 with the pin 81 of the bellcrank lever 73.

Figure 5:
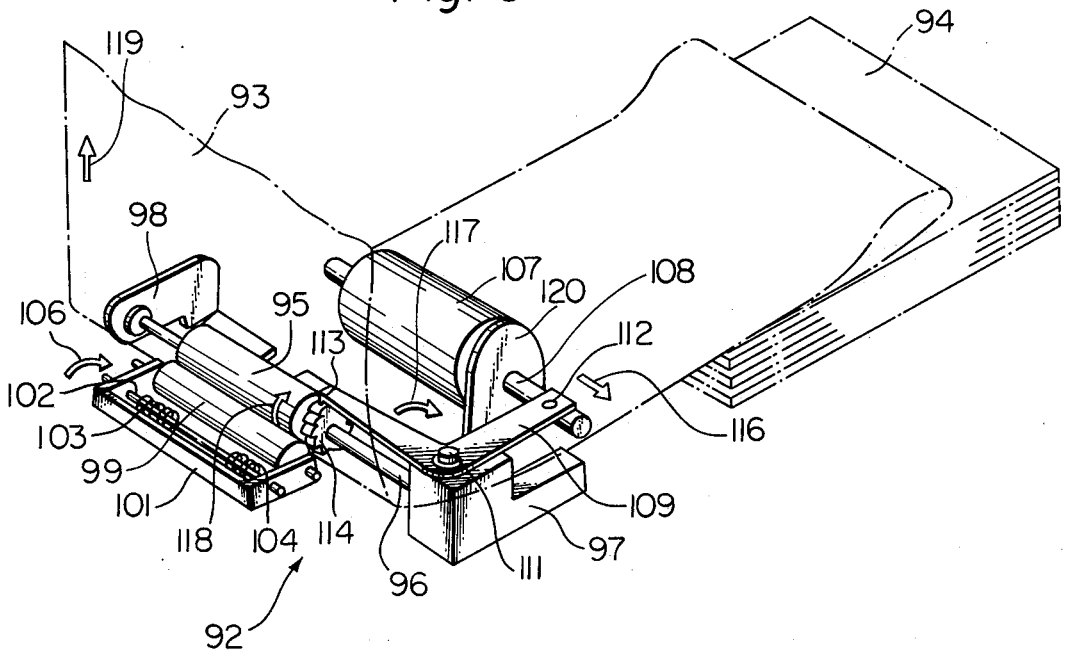
FIG. 5 is a perspective view of a paper feed mechanism of the printing apparatus.

A paper feed mechanism which is shown in FIG. 5 and generally designated as 92 is provided to feed printing paper 93 between the hammers 71 and 72 and the type wheels 24 and 26 in the manner illustrated in FIGS. 2 and 3 one printing line at a time. The paper 93 may be provided in a roll or folded into a stack 94 as shown. The feed mechanism 92 comprises a feed roller 95 which is fixed to a shaft 96 which is rotatable supported at its ends by brackets 97 and 98. An idler roller 99 is rotatably supported by a frame 101 which is in turn rotatably supported by a shaft 102. Torsion springs 103 and 104 are connected between the shaft 102 and the frame 101 to urge the frame 101 in the direction indicated by an arrow 106 and the idler roller 99 toward the feed roller 95 so that the paper 93 is pressed between the rollers 95 and 99. It is to be appreciated that the torsion spring 103 and 104 may be connected in such a manner that one end of the spring 103 is fixed to the frame 22 and the other end thereof is fixed to the frame 101, while similarly one end of the spring 104 is fixed to the frame 22 and the other end thereof is fixed to the frame 101. In this case, each of the springs 103 and 104 is also partially fixed to the shaft 102.

A line feed solenoid 107 which is supported by the bracket 120 comprises a plunger 108. The solenoid 107 is of the same type as the solenoid 51 in that the application of an electrical signal causes the plunger 108 to extend. A line feed pawl 109 is pivotally supported by the bracket 97 about a pin 111 and is pivotally connected at one end thereof to the plunger 108 by a pin 112. The other end 113 of the pawl 109 operatively engages with a ratchet 114 fixed to the shaft 96.

When the solenoid 107 is energized by an electrical line feed signal, the plunger 108 is extended as indicated by an arrow 116. This causes the pawl 109 to pivot clockwise as indicated by an arrow 117 and rotate the ratchet 114, shaft 96 and feed roller 95 by a distance corresponding to one tooth of the ratchet 114 as indicated by an arrow 118 so that the paper 93 is moved upwardly as indicated by an arrow 119. Upon termination of the electical signal, the plunger 108 is retracted into the solenoid 107 proper and the pawl 109 is returned to its original position. Although not shown, a holding pawl is provided to the ratchet 114 to prevent rotation thereof in the direction opposite to the arrow 118. The pawl 109 is further formed of a resilient material so as to resiliently deform and allow the end 113 to ride over the next tooth of the ratchet 114 as the pawl 109 is returned to its original position. In this manner, the paper 93 is fed upwardly by a space corresponding to one tooth of the ratchet 114 which in turn corresponds to one line of printing each time a line feed signal is applied to the solenoid 107.

Figure 4:
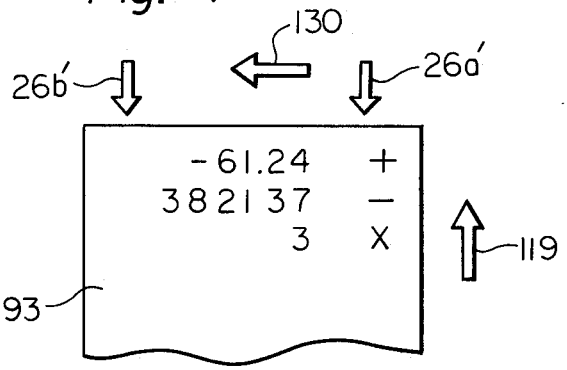
FIG. 4 is a fragmentary view of a sheet illustrating the printing arrangement of the printing apparatus.

The arrow 119 is also shown in FIG. 3 and 4 to illustrate the direction of feed of the paper 93. FIG. 4 illustrates the printing arrangement of the printing apparatus 21. The first type wheel 24 is provided in a fixed position to print the mathematical operator symbols "+", "−" and "×" in the rightmost column of the paper 93 as shown. The second type wheel 26 is movable in the direction indicated by an arrow 130 in FIGS. 1, 2 and 4 to print the digits of a number on the paper 93. As shown in FIG. 4, the printing direction is from right to left and the least significant digit is printed first followed by the other digits in order of significance. The first position **26*a* of the second type wheel 26 is indicated by an arrow 26*a*' and is located one printing position to the right of the least significant digit. The second position 26*b* of the second type wheel 26 is indicated by an arrow 26*b*' and is located one digit position to the left of the leftmost printing position of the printing apparatus 21.**

The operation of the printing apparatus 21 will now be described with reference to the drawings, in which it will be assumed that the printing apparatus 21 is incorporated in an electronic calculator of conventional construction which is not shown.

Figure 13:
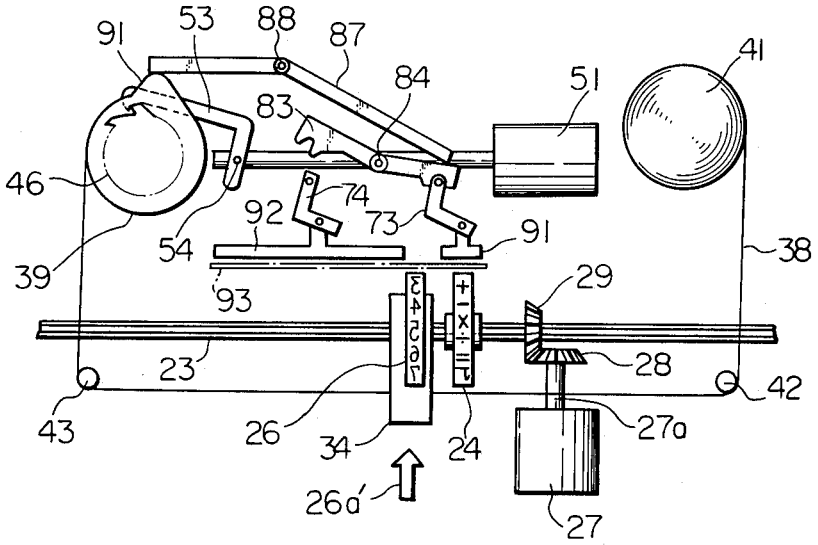
FIGS. 13 to 16 are simplified diagrams illustrating the operation of the printing apparatus.

The calculator operator enters a number for mathematical computation into the calculator by means of a keyboard (not shown), and then presses a function key, for example "+", to order the calculator to add the number entered to the current total. In this condition, the printing apparatus 21 is as shown in FIGS. 8 and 13 with the second type wheel 26 in the first position **26*a* as indicated by the arrow 26*a*'. The cam 91 is positioned in such a manner that the maximum radius portion thereof is in engagement with the selector arm 87 rotating the arm 87 clockwise to engage with the right end of the selector lever 83 to engage the fork 83*a* thereof with the pin 81 of the bellcrank lever 73. In this manner, the plunger 52 is drivingly connected to the first printing hammer 71 through the selector lever 83, pin 81 and bellcrank lever 73.**

As the operator depresses the function key, the entered number is latched into a buffer register (not shown) from which it is accessed for electronic computation. Depression of the function key also actuates the control unit (not shown) of the calculator to control the printing apparatus 21 to print the number and the function or operator symbol.

The control unit applies electrical pulses to the stepping motor 27 to rotate the spline shaft 23 and thereby the type wheels 24 and 26. As the chip **31*a* on the disc 31 aligns with the sensor 32, the sensor 32 produces an electrical signal indicating that the shaft 23 is in a starting position which is fed to the control unit. Upon receipt of this signal the control unit feeds to the stepping motor 27 a number of drive pulses sufficient to rotate the first type wheel 24 to a position such that the function symbol thereon corresponding to the function key which was depressed faces the first printing hammer 71. The stepping motor 27 is de-energized when the shaft 23 and type wheel 24** reach this position.

Subsequently, the control unit feeds an electrical signal to the solenoid 51 which causes the plunger 52 to be extended. As viewed in FIGS. 9 and 13, the plunger 52 is moved leftwardly so that the selector lever 83 is carried leftwardly therewith by means of the pin 84. Since the fork **83*a* is in engagement with the pin 81 of the bellcrank lever 73, the bellcrank lever 73 is rotated counterclockwise. This causes the printing hammer 71 to rotate as indicated by an arrow 150 in FIG. 1 so that the hammer plate 71*a* of the hammer 71 moves the paper 93 to impact with the first type wheel 24 and print the function symbol on the paper 93 in the position shown in FIG. 4.**

Leftward movement of the plunger 52 also causes the feed pawl 53 to move leftwardly and ride over the next tooth of the ratchet 46 in the counterclockwise direction about the periphery of the ratchet 46. This action is enabled by the spring 56 which resiliently yields. Counterclockwise rotation of the ratchet 46 is prevented by the holding pawl 57.

Figure 10:
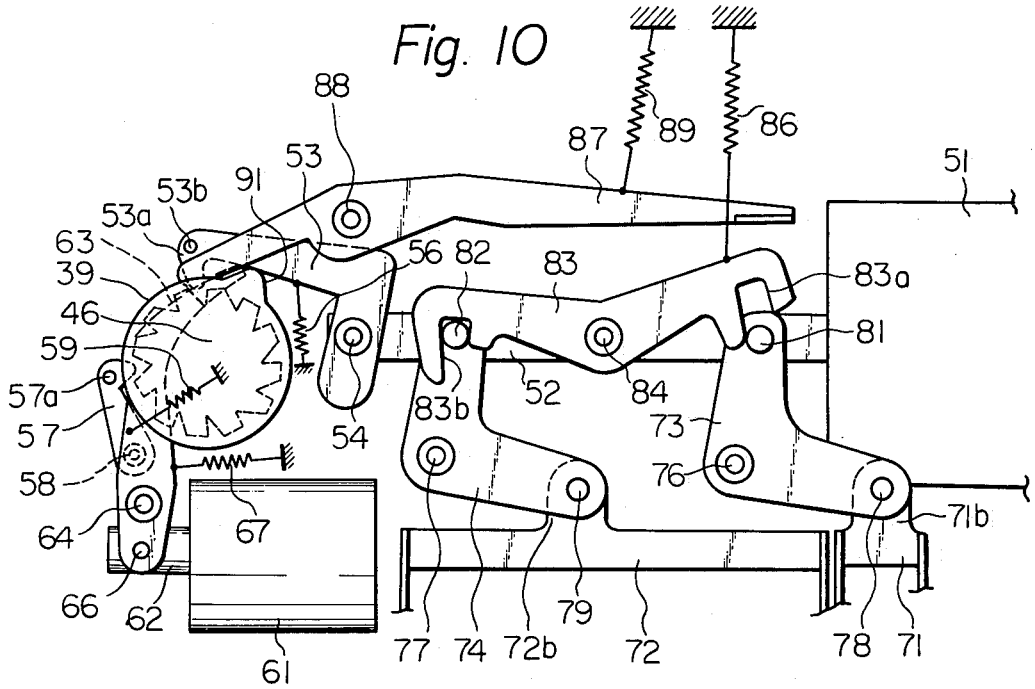
Figure 14:
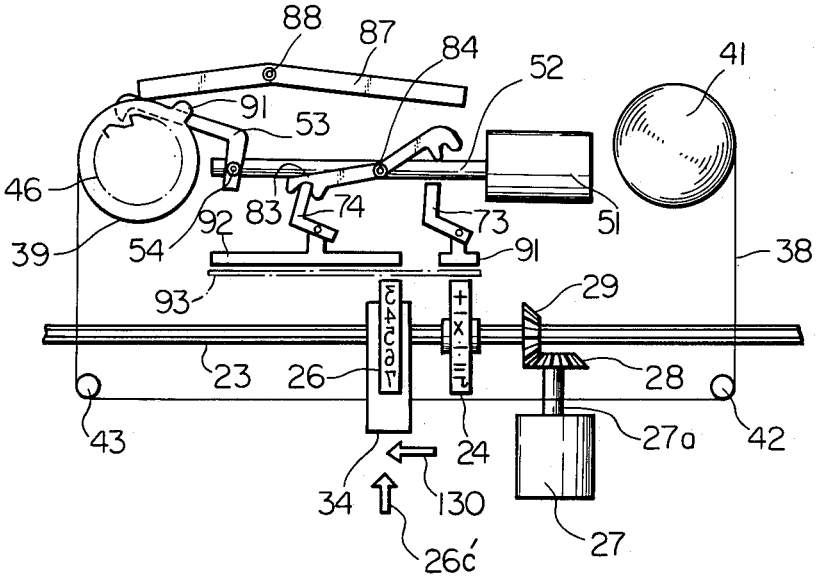

After the printing operation is completed, the plunger 52 is retracted into the solenoid 51 as shown in FIGS. 10 and 14. This rightward movement of the plunger 52 causes the first printing hammer 71 to return to its non-printing position in a movement which is exactly opposite to the printing movement. The feed pawl 53 is also moved rightwardly in such a manner as to rotate the ratchet 46 clockwise by one tooth. This causes the spools 39 and 41 to rotate clockwise thereby moving the carriage 34 and the second type wheel 26 leftwardly from the first position **26*a* to a position indicated by an arrow 26*c*' in FIG. 14 corresponding to the printing position of the least significant digit on the paper 93 opposite the right end of the second printing hammer 72.**

Figure 11:
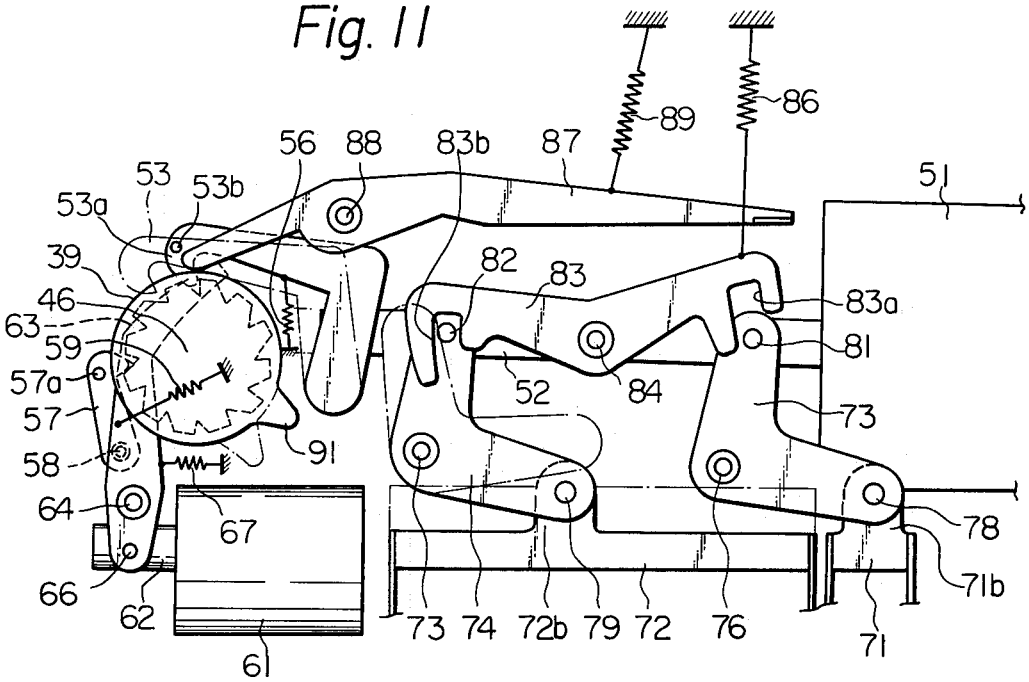

The return movement of the plunger 52 and the clockwise rotation of the ratchet 46 and spool 39 causes the largest radius portion of the cam 91 to disengage from the left end of the selector arm 87 thereby allowing the spring 89 to rotate the arm 87 counterclockwise out of engagement with the selector lever 83. This further allows the spring 86 to rotate the selector lever 83 counterclockwise so that the fork **83*a* disengages from the pin 81 of the bellcrank lever 73 and the fork 83*b* at the left end of the selector lever 83 engages with the pin 82 of the bellcrank lever 74 to drivingly connect the plunger 52 to the second printing hammer 72 by means of the pin 82 and bellcrank lever 74 as shown in solid line in FIG. 11.**

Next, the control unit feeds electical signals to the stepping motor 27 causing rotation of the spline shaft 23 and type wheels 24 and 26 to position the digit symbol on the second type wheel 26 corresponding to the least significant digit of the entered number to be positioned facing the second printing hammer 72 in the manner described above with reference to the first type wheel 24. The solenoid 51 is then again actuated to move the plunger 52 leftwardly. As viewed in FIG. 11, the leftward movement of the plunger 52 causes the drive pawl 53 to ride over the next tooth of the ratchet 46 in the same manner as in the symbol printing operation as indicated in phantom line in FIG. 11. However, in this case the second hammer 72 is actuated through the pin 82 and bellcrank lever 74 to print the least significant digit of the entered number.

Figure 15:
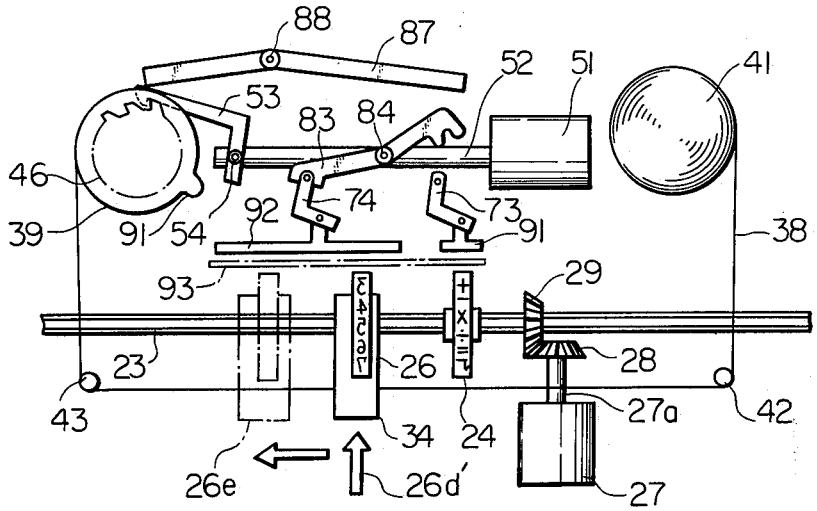

After the printing operation, the solenoid 51 is deenergized thereby causing the ratchet 46 to be advanced by another tooth and the second type wheel 26 to be moved by means of the spools 39 and 41, cable 38 and carriage 34 to a position indicated by an arrow 26*d'* in FIG. 15. It will be noted that the selector arm 87 remains out of engagement with the largest radius portion of the cam 91 and the fork 83*b* of the selector lever 83 remains engaged with the pin 82 of the bellcrank lever 74 thereby drivingly connecting the plunger 52 to the second printing hammer 72. The position indicated by the arrow 26*d'* in FIG. 15 corresponds to the second least significant digit position of the entered number.

The printing operation described above is repeated to print all of the digits of the number in such a manner that the second type wheel 26 is moved leftwardly by one digit position during each printing operation. It will be assumed that all the digits have been printed when the second type wheel 26 reaches a position 26*e* shown in phantom line.

Figure 12:
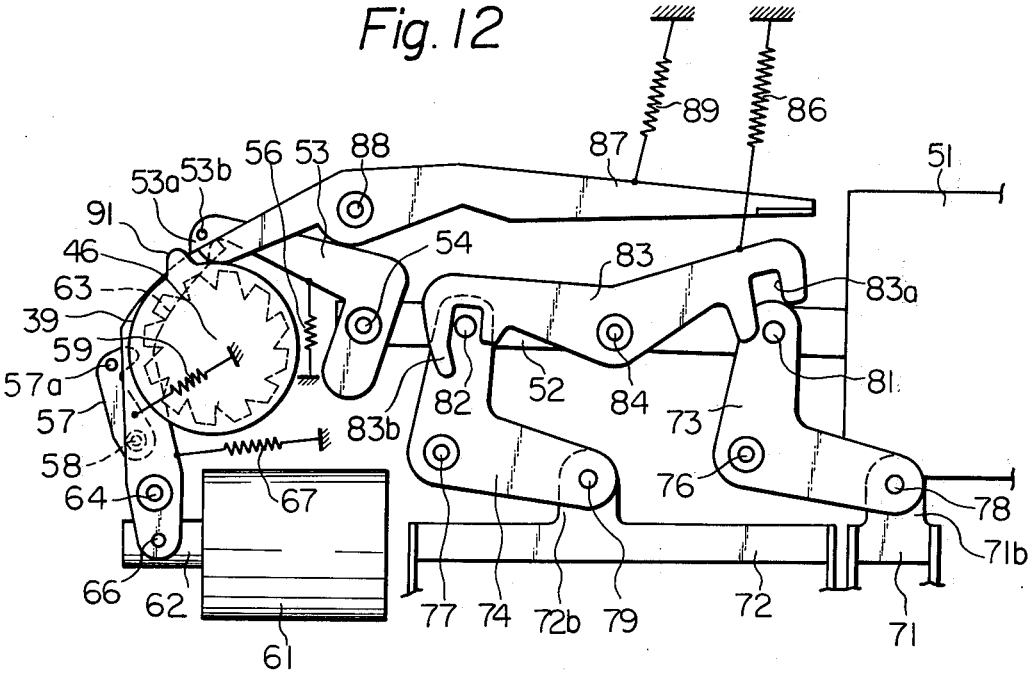
Figure 16:
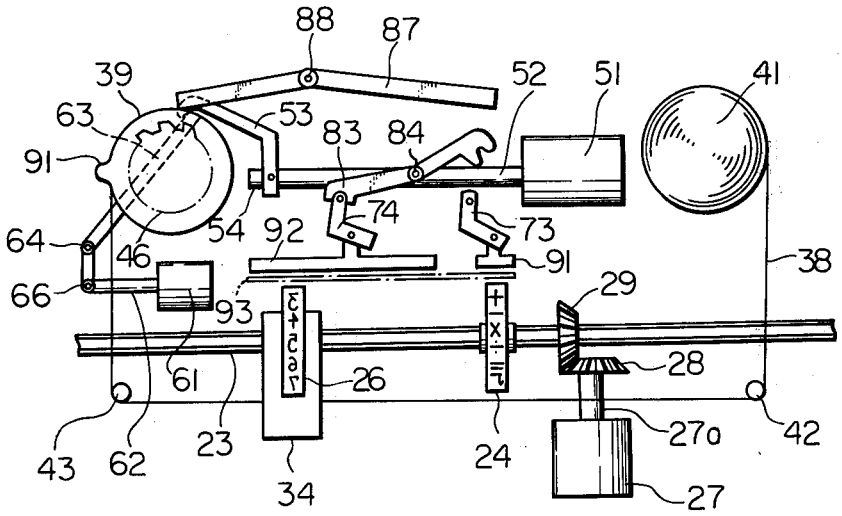

After printing the last digit, the control unit feeds a carriage return signal to the solenoid 61 causing the plunger 62 to be retracted thereby causing the actuator lever 63 to pivot counterclockwise to move the pawls 53 and 57 out of engagement with the ratchet 46. This action is illustrated in FIGS. 12 and 16. With the ratchet 46 released, the spring 49 of the take-up spool 41 rotates the spools 39 and 41 counterclockwise to move the cable 38, carriage 34 and second type wheel 26 to the first position 26*a* in preparation for printing the next number. With the second printing wheel 26 in the first position 26*a*, the selector arm 87 is moved by the cam 91 to engage the selector lever 83 with the first printing hammer 71 as shown and described with reference to FIG. 8. Upon de-energization of the solenoid 61, the pawls 53 and 57 are returned to engagement with the ratchet 46. The solenoid 107 of the paper feed unit 82 is then actuated by the control unit to feed the paper 93 upwardly by one line so that the next number and function symbol may be printed below the first.

It will be understood that the second type wheel 26 need not be moved to the second position 26*b* and will only be moved to the second position 26*b* when the entered number comprises the maximum number of digits which the printing apparatus 21 is designed to accomodate. As soon as the most significant digit is printed, the carriage return solenoid 61 is energized to reset the printing apparatus 21 in preparation for printing another number and function symbol on the next line.

It will be understood that the cable 38 may be replaced by a wire, string, belt, chain or the like in either the configuration described and illustrated or an endless configuration. Many other modifications within the scope of the invention will become possible for those skilled in the art after receiving the teachings of the present disclosure.

What is claimed is:

1. A printing apparatus comprising:

a rotatable spline shaft;

a first type wheel fixedly mounted on the spline shaft, the first type wheel being formed with a plurality of first type symbols on the circumference thereof;

a second type wheel longitudinally slidably mounted on the spline shaft for unitary rotation therewith, the second type wheel being formed with a plurality of second type symbols on the circumference thereof;

type selector drive means for rotating the spline shaft and thereby the first and second type wheels for type symbol selection;

stepping drive means for steppingly moving the second type wheel along the spline shaft from a first position to a second position;

a first printing hammer movably disposed adjacent to the first type wheel;

a second printing hammer movably disposed adjacent to the second type wheel, the second printing hammer extending between the first and second positions;

reciprocating drive means having reciprocating actuator member connected to the stepping drive means; and hammer selector means for selectively connecting one of the first and second printing hammers to the actuator member in such a manner that the actuator member moves the selected one of the first and second printing hammers to strike the respective one of the first and second type wheels for printing when the actuator member is moved in a first direction and actuates the stepping drive means to move the second type wheel along the spline shaft by one step when the actuator member is moved in a second direction which is opposite to the first direction.

2. A printing apparatus as in claim 1, further comprising return drive means to selectively return the second type wheel to the first position.

3. A printing apparatus as in claim 1, in which the reciprocating drive means comprises an electrical solenoid having a plunger which constitutes the actuator member.

4. A printing apparatus as in claim 1, in which the type selector drive means comprises a stepping motor.

5. A printing apparatus as in claim 1, in which the stepping drive means comprises a carriage connected to the second type wheel for unitary movement, a rotary drive spool, a rotary take-up spool, a cable wound around the drive and take-up spools and being connected to the carriage in such a manner that rotation of the drive spool winds the cable therearound and moves the carriage and second type wheel from the first position toward the second position, a ratchet fixed to the drive spool and a drive pawl connected to actuator member of the reciprocating drive means to steppingly rotate the ratchet and drive spool.

6. A printing apparatus as in claim 1, in which the hammer selector means comprises first and second engaging members provided to the first and second printing hammers respectively, a hammer selector lever pivotally mounted on the actuator member of the reciprocating drive means and being formed with first and second engaging portions and a hammer selector member engageable with the selector lever to move the selector lever in such a manner that a selected one of the engaging portions of the selector lever engages with the respective engaging member of the selected one of the first and second printing hammers.

7. A printing apparatus as in claim 5, in which the hammer selector means comprises first and second engaging members provided to the first and second printing hammers respectively, a hammer selector lever pivotally mounted on the actuator member of the reciprocating drive means and being formed with first and second engaging portions and a hammer selector member engageable with the selector lever, the drive spool being formed with a cam engaging with the selector member in such a manner as to move the selector member and thereby the selector lever to engage the first engaging portion of the selector lever with the first engaging member of the first printing hammer when the drive spool is in a first rotational position corresponding to the first position of the second type wheel and to engage the second engaging portion of the selector lever with the second engaging member of the second printing hammer when the drive spool is rotated away from the first position and the second type wheel is correspondingly moved away from the first position toward the second position thereof.

8. A printing apparatus as in claim 5, further comprising carriage return drive means to return the carriage and the second type wheel to the first position, the return drive means including biasing means urging the take-up spool to wind the cable therearound and move the carriage and thereby the second type wheel to the first position and return actuator means for moving the drive pawl out of engagement with the ratchet.

9. A printing apparatus as in claim 8, further comprising a holding pawl biased toward engagement with the ratchet to prevent rotation of the ratchet and the drive spool in a direction corresponding to movement of the carriage and second type wheel to the first position, the return actuator means being arranged to move both the drive pawl and the holding pawl out of engagement with the ratchet.

10. A printing apparatus as in claim 9, in which the return actuator means comprises an electrical solenoid having a plunger and a return actuator member connected to the plunger and being engageable with the drive pawl and the holding pawl to move the drive pawl and the holding pawl out of engagement with the ratchet.

* * * * *